US006104370A

United States Patent [19]

Nakagaki et al.

[11] Patent Number: 6,104,370

[45] Date of Patent: Aug. 15, 2000

[54] APPARATUS AND METHOD OF DRIVING ACTIVE MATRIX LIQUID CRYSTAL DISPLAY

[75] Inventors: Shintaro Nakagaki, Miura; Tsutou Asakura, Odawara; Masato Furuya, Yokosuka, all of Japan

[73] Assignee: Victor Company of Japan, Ltd., Yokohama, Japan

[21] Appl. No.: 09/179,407

[22] Filed: Oct. 27, 1998

[30] Foreign Application Priority Data

Oct. 27, 1997 [JP] Japan ..... 9-311448

[51] Int. Cl.[7] ..... G09G 3/36

[52] U.S. Cl. ..... 345/100

[58] Field of Search ..... 349/33, 151, 34; 345/92, 100, 55, 56, 94, 98, 99

[56] References Cited

U.S. PATENT DOCUMENTS 5,151,689 9/1992 Kabuto et al. ..... 340/784

OTHER PUBLICATIONS

H. Asada et al, IEEE International Conference, vol. 39, "A 2.7in 1.3MPixel Driver–Integrated . . . ", pp. 190–191, Feb. 1996.

*Primary Examiner*—William L. Sikes
*Assistant Examiner*—Tai V. Duong
*Attorney, Agent, or Firm*—Jacobson, Price, Holman & Stern, PLLC

[57] ABSTRACT

A liquid crystal displaying apparatus has an active matrix liquid crystal display provided with a plurality of liquid crystal displaying devices arranged in a horizontal and a vertical direction to form a matrix. The apparatus further includes a horizontal driver provided along rows of the devices, a first vertical driver provided along the leftmost column of the devices and a second vertical driver provided along the rightmost column of the devices. The horizontal driver supplies video signals to the devices by scanning the devices left to right or right to left in a direction of the rows. The first vertical driver supplies control signals to the liquid crystal display to turn on the devices from the leftmost to the rightmost column of the devices when the horizontal driver scans the devices left to right in the direction of the rows. On the other hand, the second vertical driver supplies control signals to the liquid crystal display to turn on the devices from the rightmost to the leftmost column of the devices when the horizontal driver scans the devices right to left in the direction of the rows. The horizontal driver may include a first horizontal driving section provided along the uppermost row of the devices and a second horizontal driving section provided along the lowermost row of the devices. The first horizontal driving section scans the devices left to right in the direction of the rows or the second horizontal driving section scans the devices right to left in the direction of the rows in response to a selection signal.

5 Claims, 7 Drawing Sheets

APPARATUS AND METHOD OF DRIVING ACTIVE MATRIX LIQUID CRYSTAL DISPLAY

BACKGROUND OF THE INVENTION

The present invention relates to an apparatus and a method of driving an active matrix liquid crystal display (called LCD hereinafter) having a horizontal driver which is capable of reversing pixel signal writing order.

There has been a strong demand for video projectors, flat displays, etc., provided with an active matrix LCD. A video projector is classified into transmission-type and reflection-type. The former type uses a transmission-type LCD as a light valve which modulates light beams per pixel and projects the modulated beams onto a screen. The latter type is provided with a reflecting electrode layer of reflecting pixel electrodes by which light beams are reflected and projected onto a screen.

FIG. 1 shows a conventional active matrix LCD apparatus for reflection-type video projectors. An LCD 31 is provided with MOSFETs 2 arranged in a matrix. The MOSFETs 2 correspond to pixels PX1i to PXnm. Connected to each MOSFET 2 are a charge storage capacitor 3 and a liquid crystal capacitor 25*c* of a liquid crystal layer. These capacitors are depicted as an equivalent circuit to a liquid crystal displaying device for one pixel.

A gate pulse is supplied from a vertical driver 10 to each gate line 16 to turn on the MOSFETs 2 connected to the gate line. A pixel signal is then supplied from a horizontal driver 15 to the charge storage capacitor 3 connected to each turned-on MOSFET 2.

More in detail, the vertical driver 10 sequentially selects the gate lines in a vertical direction of the matrix to output gate pulses. For each output gate pulse, the horizontal driver 15 supplies pixel signals to horizontally arranged turned-on MOSFETs 2 corresponding to the pixels (PX1i to PXni) to (PX1m to PXnm) to form an image for one field or one frame. Light beams incident to the LCD 31 are modulated per pixel, reflected therefrom and projected onto a screen (not shown).

The horizontal driver 15 is provided with a shift register (not shown) for driving the MOSFETs 2 in a forward or a reverse direction, that is, from the pixel PX1i to PXni or from PXni to PX1i to switch the horizontal scanning direction.

When the LCD 31 is applied to a video projector, a projected image is switched right and left in accordance with a type of the video projector, that is, front projection-type or rear projection-type. The projector is placed in front of a screen in the former type. On the other hand, it is placed behind the screen in the latter type.

Furthermore, when the LCD 31 is applied to a 3-LCD panel liquid crystal displaying device, at least one of images supplied to the three panels is switched right and left in accordance with the mechanism of the optical guidance and synthesizing system installed in the device. Here, the liquid crystal displaying device modulates separated reading light beams for colors of R, G and B on three LCD panels and syntheses the modulated light beams.

The horizontal driver 15 provided with such a shift register for driving the MOSFETs 2 in a forward or a reverse direction as described above however has drawbacks as follows:

Each gate line 16 shown in FIG. 1 has an internal resistor Re and a floating capacitor Ce as shown in FIG. 2A. The floating capacitor Ce exists between the gate line 16 and a silicon substrate for the liquid crystal. Therefore, as shown in FIG. 2B, the internal resistor Re and floating capacitor Ce form a capacitor-resistor (C-R) circuit composed of a capacitor Ct and a resistor Rt between PX1i and PXni.

Suppose that the horizontal driver 15 shown in FIG. 1 is set in the right scanning direction mode in which pixel signals (SIG) are supplied to the LCD 31 in the order of (PX1i→PX2i→ . . . →PXni). The pixel signals are shown in FIG. 3A where the pixel signals I (SIG1, SIG2, SIG3, . . . , SIGn) and II (SIG1', SIG2', SIG3', . . . , SIGn') are for the uppermost pixels (PX1i, PX2i, PX3i, . . . PXni) and the next horizontally aligned pixels (not shown), respectively, in FIG. 1.

While a gate pulse is being supplied to the uppermost gate line 16 in FIG. 1 from the vertical driver 10, pixel signals are supplied to the charge storage capacitors 3 via the MOSFETs 2 for the pixels PX1i to PXni in the order mentioned above.

More in detail, the gate pulse shown in FIG. 3B is supplied first to the MOSFET 2 for the leftmost pixel PX1i shown in FIG. 1. The pixel signal SIG1 is also supplied to the MOSFET 2 for the pixel PX1i as shown in FIG. 3C. Also shown in FIG. 3C is the pixel signal SIG1' for the pixel (not shown) next to the pixel PX1i in the vertical direction. The gate pulse is then supplied last as shown in FIG. 3D to the MOSFET 2 for the rightmost pixel PX1n shown in FIG. 1. The pixel signal SIGn is also supplied to the MOSFET 2 for the pixel PX1n as shown in FIG. 3E. Also shown in of FIG. 3E is the pixel signal SIG n' for the pixel (not shown) next to the pixel PX1n in the vertical direction.

The closer to the leftmost pixel PX1i in FIG. 1, the smaller the totals of the resistors Re and capacitors Ce are (FIG. 2A), and the more perfect rectangular waveform the gate pulse has as shown in of FIG. 3B. The MOSFET 2 for the pixel PX1i thus samples and holds the pixel signal SIG1 at the correct timing (S/H timing) when the gate pulse falls as shown in FIGS. 3B and 3C .

On the other hand, the closer to the rightmost pixel PXni, the larger the totals of the resistors Re and capacitors Ce, and the more the gate pulse exhibits decrease in high frequency components at rising and falling moments as shown in FIG. 3D due to the existence of the C-R circuit shown in FIG. 2B.

More in detail, the closer to the rightmost pixel PXni, the more the C-R circuit acts as an integrating circuit with a larger time constant to affect the gate pulse at the rising and falling moments, thus delaying the S/H timing. However, the pixel signal SIGn supplied to the MOSFET 2 for the rightmost pixel PXn1 is also delayed as shown in FIG. 3E in the right scanning direction mode in the order of (PX1i→Px2i→ . . . →Pxni). The pixel signal SIGn thus can be supplied to the MOSFET 2 for the pixel PXni even if the S/H timing is delayed. Shown in FIGS. 3D and 3E is the worst case where the S/H timing is delayed most.

Next, suppose that the horizontal driver 15 shown in FIG. 1 is set in the left scanning direction mode in which pixel signals (SIG1, SIG2, SIG3, . . . , SIGn) shown in FIG. 4A are supplied to the LCD panel 31 in the order of (PXni→ . . . →Px2i→Px1i), thus switching the image right and left.

For the same reason given with respect to FIGS. 3B and 3C, the closer to the leftmost pixel PX1i in FIG. 1, the smaller the totals of the resistors Re and capacitors Ce are (FIG. 2A), and the more perfect rectangular waveform the gate pulse has as shown in FIG. 4B. The MOSFET 2 for the pixel PX1i thus samples and holds the pixel signal SIGn at the correct S/H timing when the gate pulse falls as shown in FIGS. 4B and 4C.

On the other hand, the closer to the rightmost pixel PXni for which the pixel signal SIG1 is supplied to the corresponding MOSFET 2, the larger the totals of the resistors Re and capacitors Ce are, and the more the gate pulse exhibits decrease in high frequency components at rising and falling moments as shown in FIG. 4D for the same reason given with respect to FIG. 3D.

The MOSFET 2 for the pixel PXni thus erroneously samples and holds the pixel signal SIG1' (not SIG1) at the timing (S/H timing) as shown in FIGS. 4D and 4E. The pixel signal SIG1' should be supplied to the MOSFET 2 (not shown) for the pixel next to the pixel PXni in the vertical direction.

Continuously erroneous sampling and holding at the pixel PXni and other pixels close to PXni due to a large time constant for the C-R circuit shown in FIG. 2B would produce deviation of horizontal scanning lines at the right side of the LCD 31 as shown in FIG. 5.

This deviation would affect an image projected onto a screen, that is, an image of a field or frame next to the present field or frame would be projected at the right side of the screen.

SUMMARY OF THE INVENTION

A purpose of the present invention is to provide an apparatus and method of driving an active matrix LCD having a horizontal driver which is capable of reversing pixel signal writing order without such horizontal scanning line deviation discussed above.

The present invention provides a liquid crystal displaying apparatus comprising: an active matrix liquid crystal display provided with a plurality of liquid crystal displaying devices arranged in a horizontal and a vertical direction to form a matrix; a horizontal driver, provided along rows of the devices, to supply video signals to the devices by scanning the devices left to right or right to left in a direction of the rows; a first vertical driver, provided along a leftmost column of the devices, to supply control signals to the liquid crystal display to turn on the devices from the leftmost to a rightmost column of the devices when the horizontal driver scans the devices left to right in the direction of the rows; and a second vertical driver, provided along a rightmost column of the devices, to supply control signals to the liquid crystal display to turn on the devices from the rightmost to the leftmost column of the devices when the horizontal driver scans the devices right to left in the direction of the rows.

Furthermore, the present invention provides a method of driving an active matrix liquid crystal display provided with a plurality of liquid crystal displaying devices arranged in a horizontal and a vertical direction to form a matrix, the method comprising the steps of: scanning the devices left to right or right to left in a direction of rows of the devices to supply video signals to the devices; supplying control signals to the liquid crystal display to turn on the devices from a leftmost to a rightmost column of the devices when the devices are scanned left to right in the direction of the rows; and supplying the control signals to the liquid crystal display to turn on the devices from a rightmost to a leftmost column of the devices when the devices are scanned right to left in the direction of the rows.

DETAILED DESCRIPTION OF PREFERRED EMBODIMENTS

Figure 1:
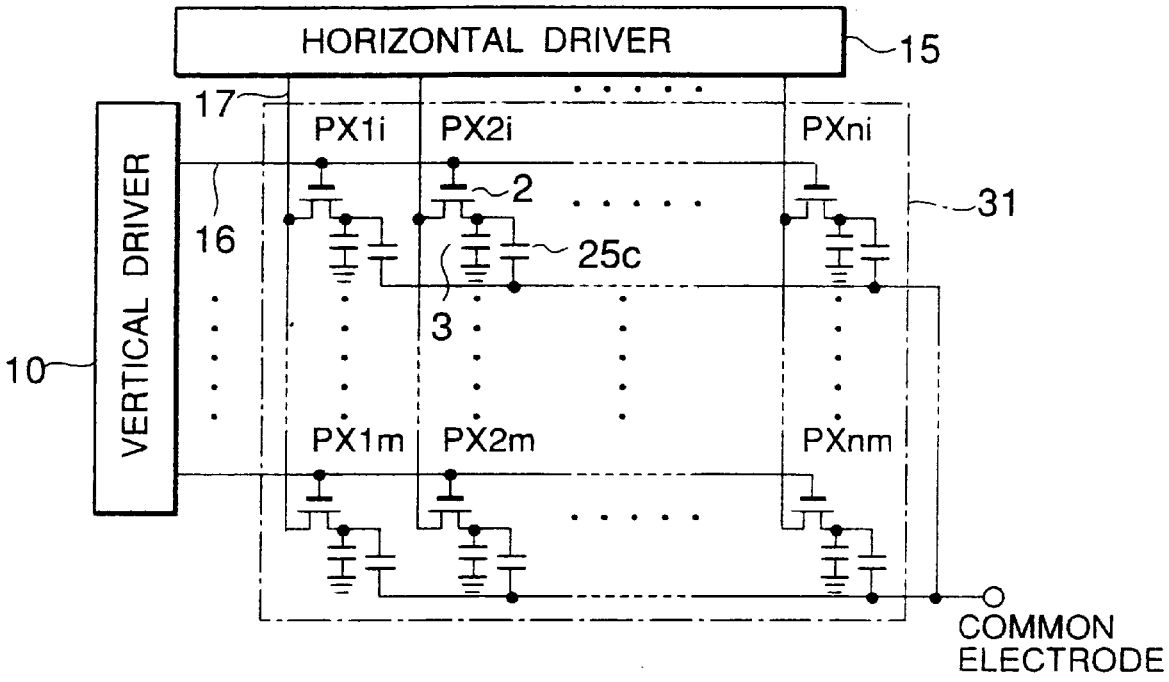
FIG.1 RELATED ART
FIG. 1 shows a conventional active matrix LCD apparatus with an equivalent circuit to an LCD of the LCD apparatus.

Preferred embodiments according to the present invention will be described with reference to the attached drawings. Elements in the embodiments that are the same as or analogous to each other between the embodiments or to elements shown in the conventional apparatus in FIG. 1 are referenced by the same reference numerals and will not be explained in detail.

Figure 6:
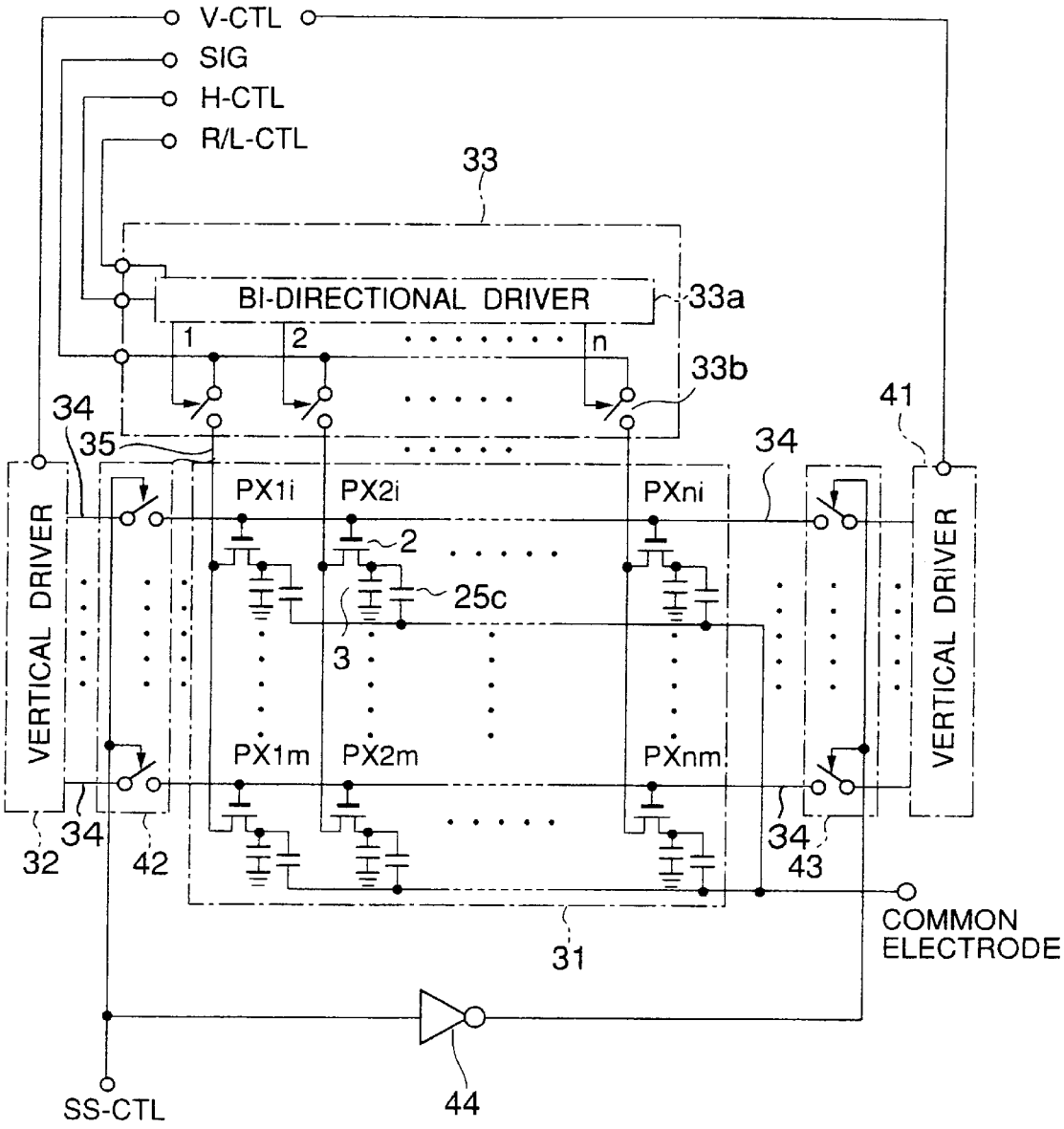
FIG. 6 shows the first preferred embodiment of an active matrix LCD apparatus according to the present invention.

FIG. 6 shows the first preferred embodiment of an active matrix LCD apparatus. The apparatus is provided with two vertical drivers 32 and 41, and a horizontal driver 33 for driving the LCD 31. The apparatus is further provided with two gate switch circuits 42 and 43, and an inverter 44 connected therebetween. The horizontal driver 33 is provided with a bidirectional shift register 33*a* and a switch circuit 33*b*.

Figure 7:
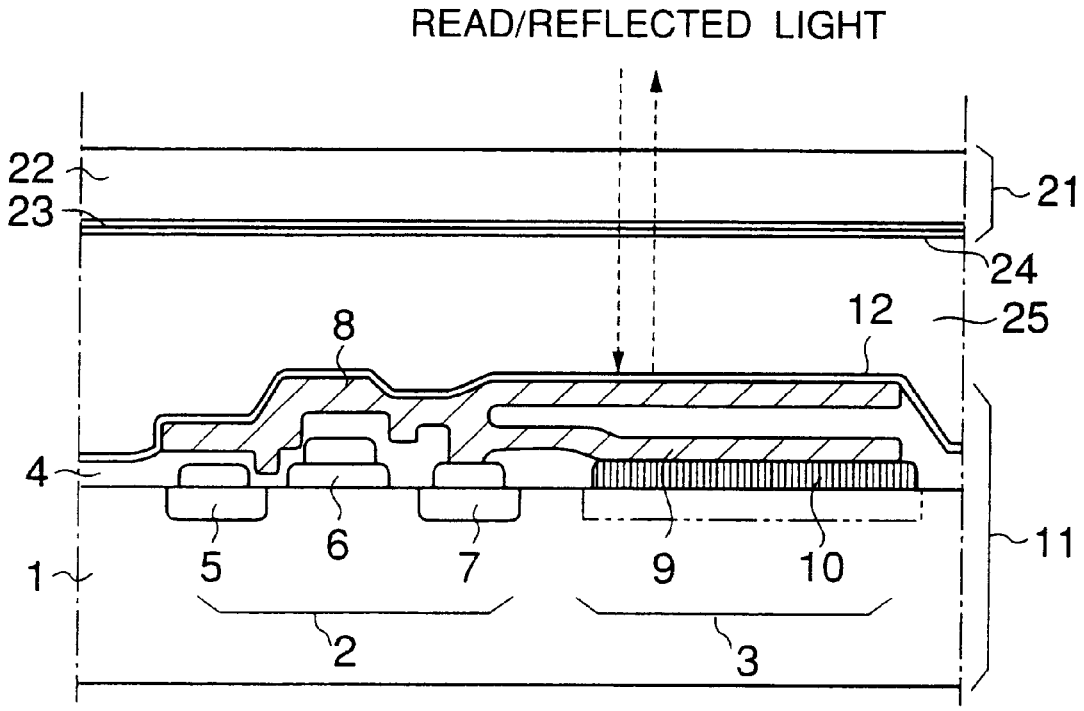
FIG. 7 illustrates one pixel portion on a display area of the LCD panel shown in FIG. 6.

One pixel portion on a display area of the LCD 31 is illustrated in FIG. 7.

In FIG. 7, formed on a silicon substrate 1 are a MOSFET 2 having a drain 5, a gate 6 and a source 7, and a capacitor 3 for storing electric charge corresponding to one pixel. These elements are covered with an insulator layer 4.

An aluminum pixel electrode (reflection electrode) layer 8 is formed on the insulator layer 4. A lower portion of the pixel electrode 8 is connected to the source 7 of the MOSFET 2. A conductor 9 extends sideways from the connecting portion. An $SiO_2$ dielectric film 10 is intervened between the substrate 1 and the conductor 9. This lamination constitutes the capacitor 3.

The MOSFET 2, the capacitor 3, the pixel electrode 8, and the substrate 1 on which these elements are formed constitute an active element substrate 11 for one pixel. A liquid crystal orientation film 12 is formed on the active element substrate 11.

A transparent substrate 21 is provided to face the active element substrate 11. The transparent substrate 21 is constituted by a glass substrate 22 and a transparent common electrode film 23 formed thereon. A liquid crystal orientation film 24 is formed on the transparent substrate 21.

A liquid crystal layer 25 is sandwiched and sealed between the active element substrate 11 and the transparent substrate 21 via the liquid crystal orientation films 12 and 24.

In FIG. 6, the vertical driver 32 or 41 supplies gate pulses to gate lines 34 via the gate switch circuit 42 or 43, respectively, based on a vertical scanning control signal V-CTL supplied to the vertical drivers. This gate pulse supplying operation will be explained later in detail.

The bidirectional shift register 33*a* of the horizontal driver 33 is driven by a horizontal scanning control signal H-CTL. The switch circuit 33*b* is controlled by outputs of the shift register 33*a* to supply pixel signals SIG included in a video signal to pixel signal lines 35.

Each gate line 34, for example, the uppermost gate line 34, is connected the gates 6 of the MOSFETs 2 aligned in the horizontal direction and corresponding to the pixels PX1i to PXni (i=1 to m). Each pixel signal line 35 is connected to the drains 5 of the MOSFETs 2 aligned in the vertical direction.

As an equivalent circuit, the capacitor 3 and the liquid crystal capacitor 25*c* are connected to the source 7 of each MOSFET 2. The liquid crystal capacitors 25*c* are connected to a common electrode (not shown).

Each MOSFET 2 turns on when a gate pulse is supplied to the gate 6 though the gate line 34. A pixel signal SIG on the pixel signal line 35 is then supplied to the reflective electrode layer 8 from the drain 5 via the source 7, and the capacitor 3 is charged simultaneously.

A potential of the reflection electrode layer 8 will be held for the period of time decided by the total capacitance of the capacitor 3 and the liquid crystal capacitor 25*c*, and the discharging resistance due to the existence of the charge stored in the capacitor 3 even if the gate pulse on the gate line 34 is turned into a low level to turn off each MOSFET 2.

A voltage produced across the reflection electrode layer 8 and the common electrode film 23 is then supplied to the liquid crystal layer 25 for the period mentioned above to generate an electric field. Liquid crystal molecules in the liquid crystal layer 25 are reoriented by the electric field to control polarization of light beams incident thereto. The light beams incident to the glass substrate 22, reflected by the reflection electrode layer 8 and emitted from the glass substrate 22 are modulated by controlling the voltage across the electrode layer 8 and the electrode film 23 using the pixel signal on each pixel signal line 35.

The gate pulse supplying operation will be explained in detail. The vertical drivers 32 and 41 output gate pulses simultaneously to the gate lines 34 via the gate switch circuits 42 and 43, respectively, in response to a vertical scanning control signal V-CTL. A plurality of switches of the gate switch circuits 42 and 43 are controlled simultaneously by a switch selection signal SS-CTL. This signal is supplied to the gate switch circuit 42 as it is but supplied to the gate switch circuit 43 after inverted by the inverter 44. The on/off state of each switch is reversed by turning the switch selection signal into a high or a low level.

Suppose that the apparatus shown in FIG. 6 is set in the right scanning direction mode in which pixel signals SIG are supplied to the LCD 31 in the order of (PX1i→PX2i→ . . . →PXni) by turning on the gate switch circuit 42 while off the gate switch circuit 43 with the switch selection signal SS-CTL. The pixel signals shown in FIG. 8A are supplied to the MOSFETs 2 at the same correct S/H timing shown in FIGS. 3A–3E without the problem discussed for the conventional apparatus.

Next, suppose that the apparatus shown in FIG. 6 is set in the left scanning direction mode in which pixel signals are supplied to the LCD panel 31 in the order of (PXni→ . . . PX2i→PX1i) by turig off the gate switch circuit 42 while on the gate switch circuit 43 with the switch selection signal.

Figure 2A:
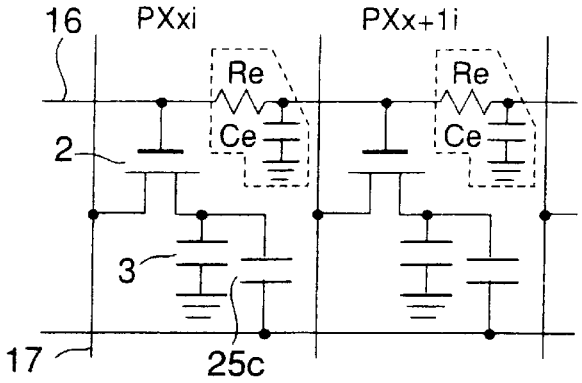
FIG. 2A is an equivalent circuit to the LCD shown in FIG. 1 with depicting internal resistance and floating capacitance produced between pixels on each gate line.
Figure 2B:
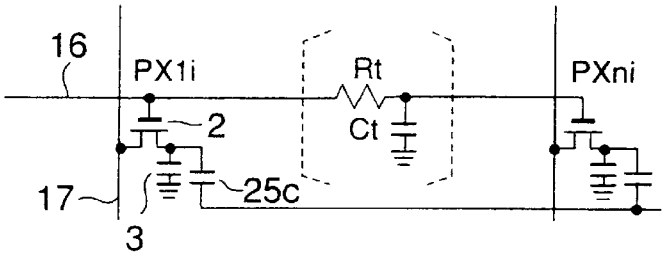
FIG. 2B is an equivalent circuit to a C-R circuit formed between pixels on each gate line.
Figure 3:
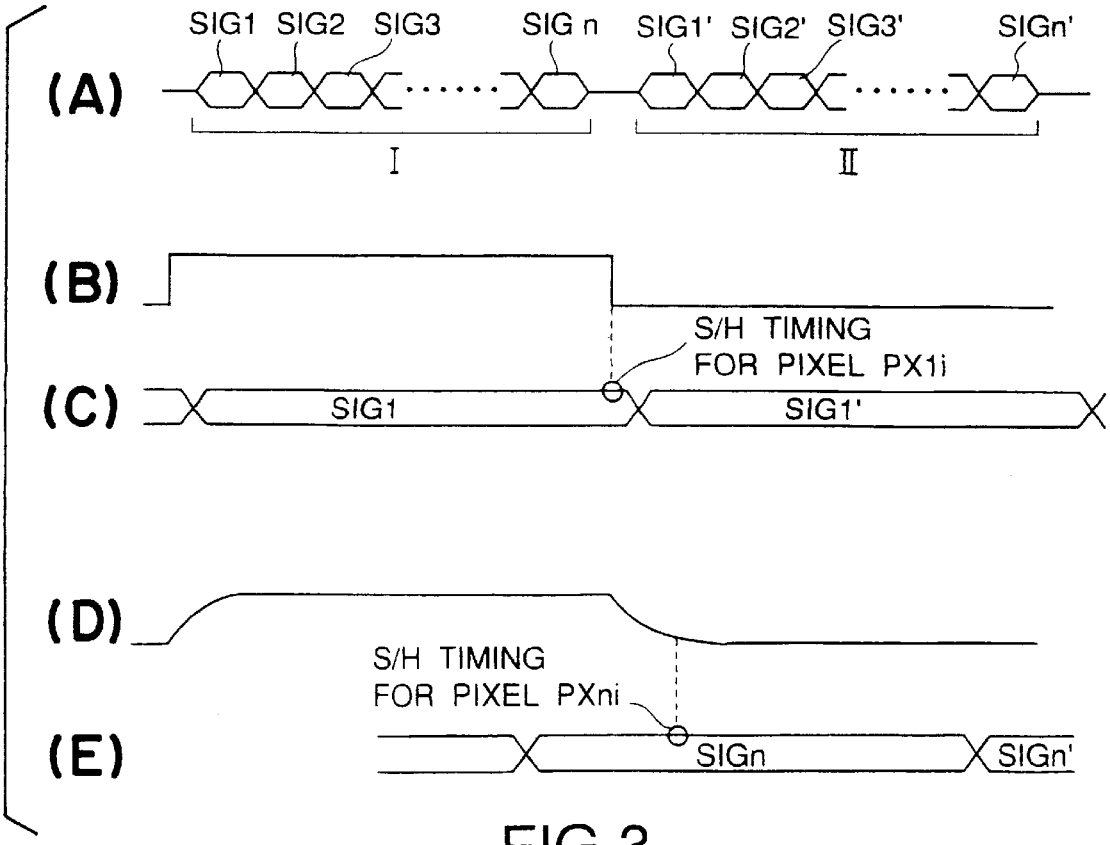
FIGS. 3A–3E illustrate a timing chart for explaining the relationship between gate pulses and pixel signals at the leftmost and rightmost sides of the LCD shown in FIG. 1 in the right scanning direction mode.
Figure 4:
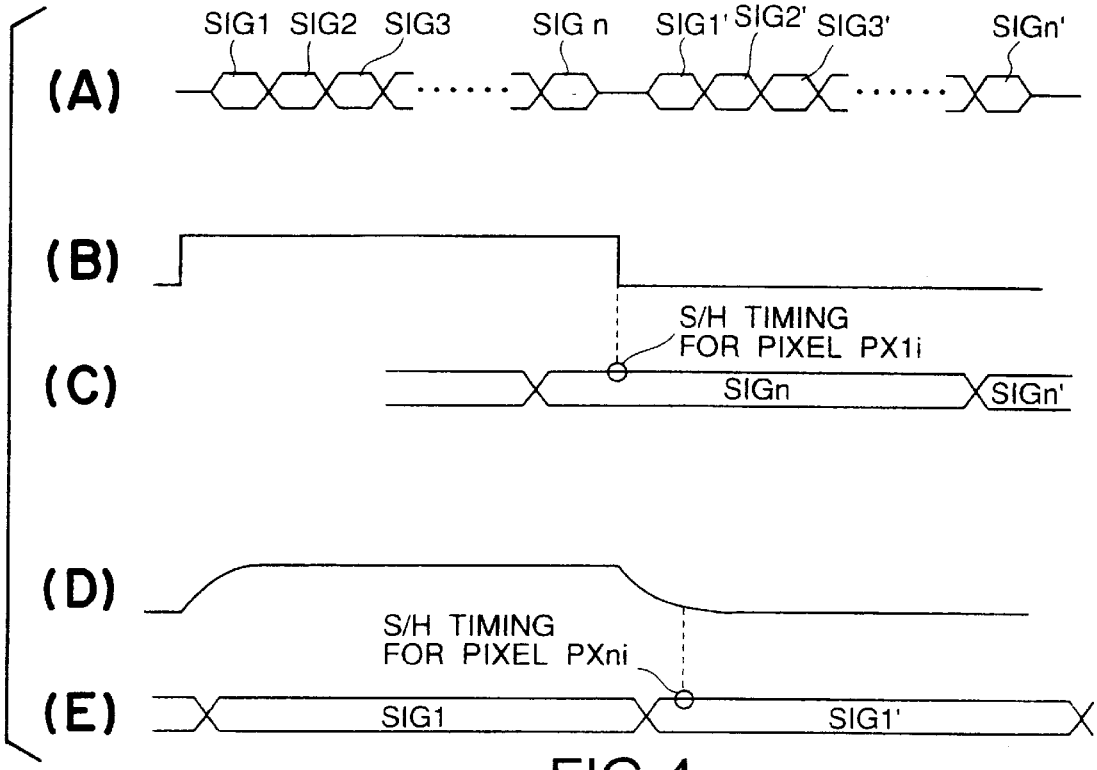
FIGS. 4A–4E illustrate a timing chart for explaining the relationship between gate pulses and pixel signals at the leftmost and rightmost sides of the LCD shown in FIG. 1 in the left scanning direction mode.
Figure 5:
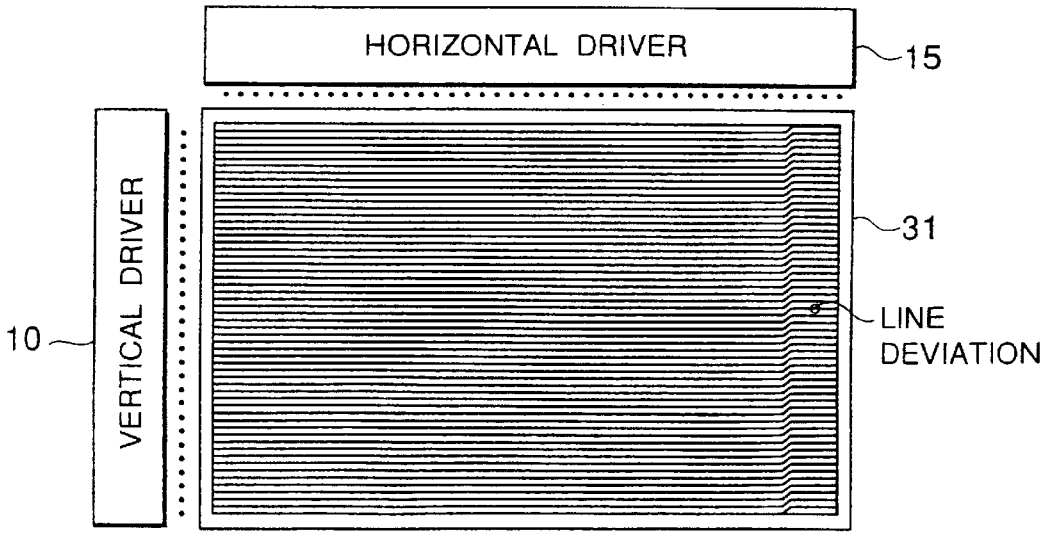
FIG. 5 illustrates an image formed on the LCD panel shown in FIG. 1 in the left scanning direction mode.

Supplying gate pulses from the vertical driver 41 via the gate switch circuit 43 in the left scanning direction mode mentioned above means that the gate pulses are supplied from the pixel PXni side in FIG. 2B.

Figure 8:
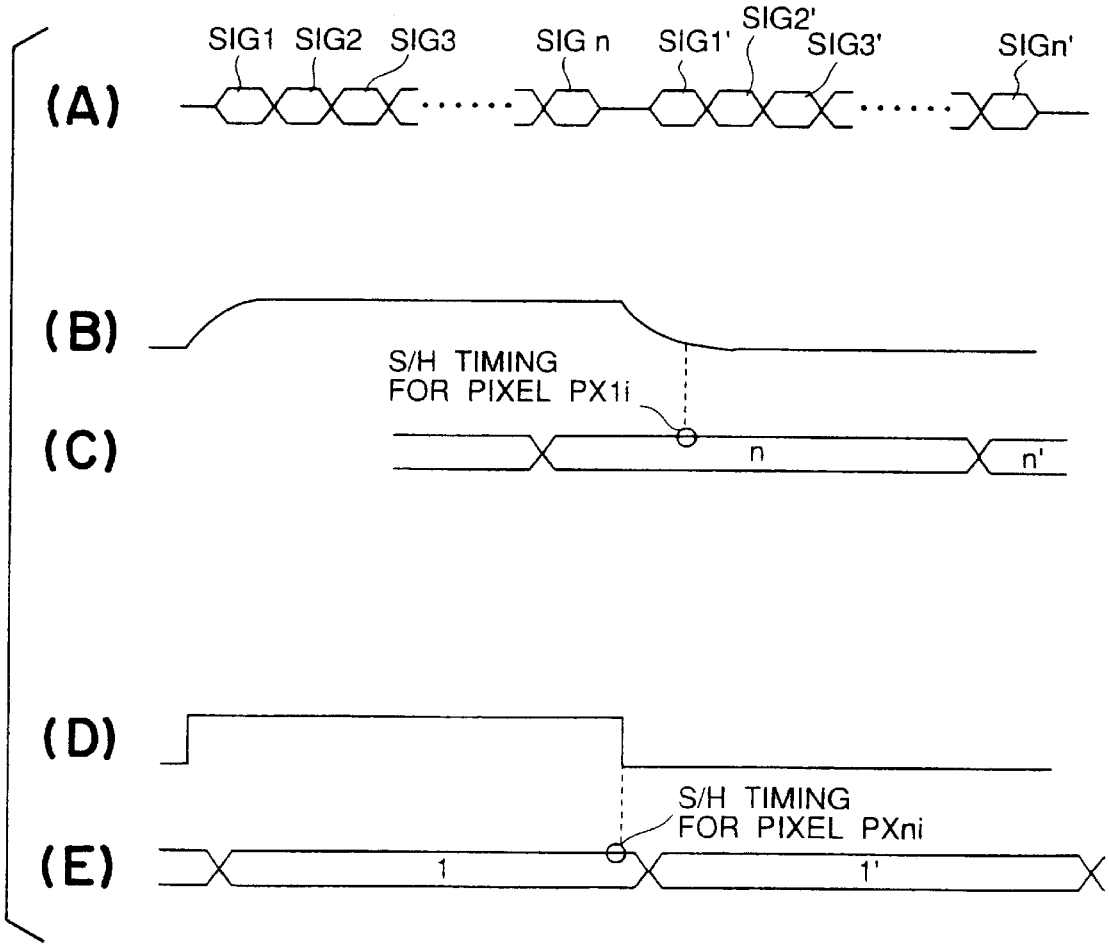
FIGS. 8A–8E illustrate a timing chart for explaining the relationship between gate pulses and pixel signals at the leftmost and rightmost sides of the LCD panel shown in FIG. 6.

The closer to the rightmost pixel PXni in FIG. 6, the smaller the totals of the resistors Re and capacitors Ce are (opposite to what is discussed with respect to FIG. 2A), and the more perfect rectangular waveform the gate pulse has as shown in FIG. 8D. The MOSFET 2 for the pixel PXni thus samples and holds the pixel signal SIG1 at the correct S/H timing when the gate pulse falls as shown in FIGS. 8D and 8E.

On the other hand, the closer to the lefttmost pixel PX1i, the larger the totals of the resistors Re and capacitors Ce, and the more the gate pulse exhibits decrease in high frequency components at rising and falling moments as shown in FIG. 8B due to the existence of the C-R circuit which is formed for the same reason given with respect to FIG. 2B.

More in detail, the closer to the leftmost pixel PX1i, the more the C-R circuit acts as an integrating circuit with a larger time constant to affect the gate pulse at the rising and falling moments, thus delaying the S/H timing. However, the pixel signal SIGn supplied to the MOSFET 2 for the leftmost pixel PX1i is also delayed as shown in FIG. 8C in the left scanning direction mode in the order of (PXni→ . . . →PX2i→PX1i). The pixel signal SIGn thus can be supplied to the MOSFET 2 for the pixel PX1i even if the S/H timing is delayed.

As described above, the active matrix LCD apparatus as the first embodiment is provided with a bidirectional horizontal driver for supplying pixel signals to an LCD and two vertical drivers arranged on both (the leftmost and the rightmost column of FETs) sides of the LCD panel for supplying gate pulses thereto. The vertical driver provided at the leftmost FET column side is turned on when the bidirectional horizontal driver is set in the right scanning direction mode. On the other hand, the vertical driver provided at the rightmost FET column side is turned on when the bidirectional horizontal driver is set in the left scanning direction mode.

This mechanism prevents deviation of horizontal scanning lines from occurring due to decrease in gate pulses in high frequency components at rising and falling moments as discussed for the conventional apparatus.

Figure 9:
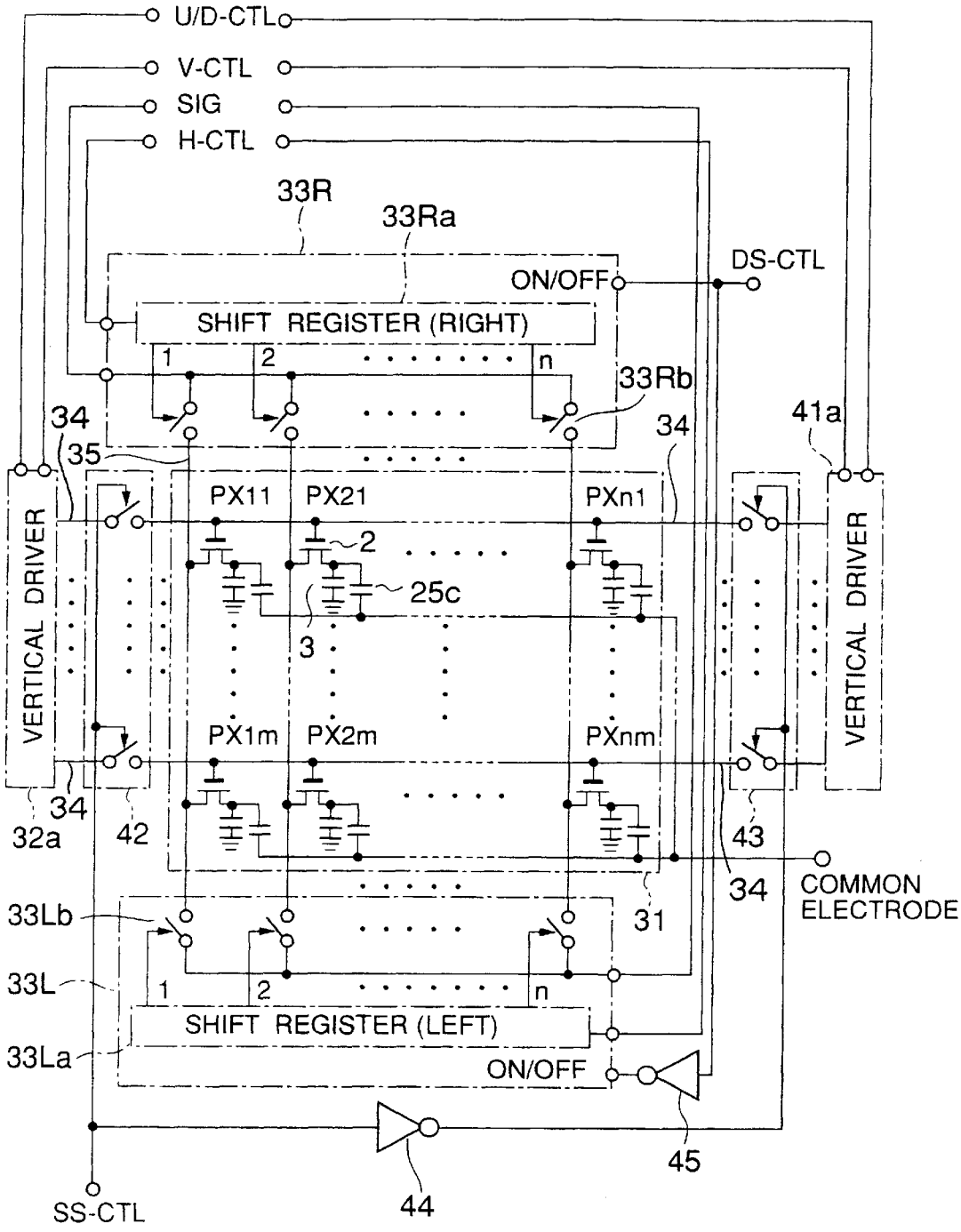
FIG. 9 shows the second preferred embodiment of an active matrix LCD apparatus according to the present invention.

FIG. 9 shows the second preferred embodiment of an active matrix LCD apparatus. The apparatus is provided with two vertical drivers 32*a* and 41*a*, two horizontal drivers 33R and 33L and an inverter 45 connected between the drivers 33R and 33L. The apparatus is further provided with the gate switch circuits 42 and 43, and the inverter 44 connected therebetween the same as shown in FIG. 6.

The horizontal driver 33R is provided with a shift register 33R*a* for the right scanning direction mode and a switch circuit 33R*b*. The horizontal driver 33L is provided with a shift register 33L*a* for the left scanning direction mode and a switch circuit 33L*b*.

The vertical drivers 32*a* and 41*a* are controlled by an up/down control signal U/D-CTL for scanning in the vertical direction, that is, the upward or the downward direction. The horizontal driver 33R is turned on while the horizontal driver 33L is off and vise versa by a drive selection signal DS-CTL which is supplied to the driver 33R as it is but is inverted by the inverter 45 before supplied to the driver 33L.

The operation of the apparatus shown in FIG. 9 when the vertical drivers 32*a* and 41*a* are set in the downward scanning direction mode is the same as that disclosed for the apparatus shown in FIG. 6. In detail, the operation when the horizontal driver 33R for the right scanning direction mode is on corresponds to the operation of the apparatus shown in FIG. 6 in which the bidirectional shift register 33*a* is set in the right scanning direction mode and the switch circuit 42 is on. On the other hand, the operation when the horizontal driver 33L for the left scanning direction mode is on corresponds to the operation of the apparatus shown in FIG. 6 in which the bidirectional shift register 33*a* is set in the left scanning direction mode and the switch circuit 43 is on.

When the image is switched upside down, the vertical drivers 32*a* and 41*a* are set in the upward scanning direction mode. The operation in the upward scanning direction mode is also basically the same as that disclosed for the apparatus shown in FIG. 6 due to the fact that the difference is only the vertical scanning direction, that is, upward or downward.

As described above, the active matrix LCD apparatus as the second embodiment also prevents deviation of horizontal scanning lines from occurring due to decrease in gate pulses in high frequency components at rising and falling moments as discussed for the conventional apparatus.

Furthermore, the second embodiment is applicable to image processing with inversion in the horizontal and/or the vertical directions (upside down and/or right and left).

Not only in the second embodiment but also in the first embodiment, the vertical drivers may be arranged such that they are controlled by an up/down control signal for scanning in the vertical direction, that is, the upward or the downward direction.

What is claimed is:

1. A liquid crystal display apparatus comprising:

an active matrix liquid crystal display provided with a plurality of liquid crystal display elements arranged in a horizontal and a vertical direction to form a matrix;

a horizontal driver, provided along rows of the elements, to supply video signals to the elements by scanning the elements from the left to the right or the right to the left in a direction of the rows;

a first vertical driver, provided along a leftmost column of the elements, to supply first control signals to the liquid crystal display to turn on the elements in the vertical direction from the leftmost to the rightmost column of the elements when the horizontal driver scans the elements from the left to the right in the direction of the rows;

a second vertical driver, provided along the rightmost column of the elements, to supply second control signals to the liquid crystal display to turn on the elements in the vertical direction from the rightmost to the leftmost column of the elements when the horizontal driver scans the elements from the right to the left in the direction of the rows;

a first switch provided between the first vertical driver and the liquid crystal display, the first control signals being supplied to the liquid crystal display via the first switch;

a second switch provided between the second vertical driver and the liquid crystal display, the second control signals being supplied to the liquid crystal display via the second switch, the first and second switches being alternately turned on in synchronism with the scanning of the elements from the left to the right or the right to the left to supply the video signals to the elements.

2. The apparatus according to claim 1, wherein the horizontal driver includes a first horizontal driving section provided along an uppermost row of the elements and a second horizontal driving section provided along a lowermost row of the elements, in response to a selection signal, the first horizontal driving section scanning the devices left to right in the direction of the rows or the second horizontal driving section scanning the elements right to left in the direction of the rows.

3. The apparatus according to claim 1, wherein, in response to a selection signal, the first or the second vertical driver turns on the elements from an uppermost to a lowermost row or from the lowermost to the uppermost row of the elements.

4. A method of driving an active matrix liquid crystal display provided with a plurality of liquid crystal display elements arranged in a horizontal and a vertical direction to form a matrix, the method comprising the steps of:

scanning the elements from the left to the right or the right to the left in a direction of rows of the elements to supply video signals to the elements;

supplying first control signals to the liquid crystal display to turn on the elements in the vertical direction from a leftmost to a rightmost column of the elements when the elements are scanned from the left to the right in the direction of the rows;

supplying second control signals to the liquid crystal display to turn on the elements in the vertical direction from the rightmost to the leftmost column of the elements when the elements are scanned right to left in the direction of the rows;

switching the first and second control signals so that the first and second control signals are alternately supplied to the liquid crystal display in synchronism with the scanning of the elements from the left to the right or the right to the left to supply the video signals to the elements.

5. The method according to claim 4, wherein the elements are turned on from an uppermost to a lowermost or from the lowermost to the uppermost row of the elements.

* * * * *